US010872508B2

(12) United States Patent
Bacallao et al.

(10) Patent No.: US 10,872,508 B2
(45) Date of Patent: Dec. 22, 2020

(54) COLLECTION BOX FOR POINT-OF-SALE PRINTED MATTER

(71) Applicant: Walmart Apollo, LLC, Bentonville, AR (US)

(72) Inventors: Yurgis Mauro Bacallao, Centerton, AR (US); Amber Roehrs, Bella Vista, AR (US)

(73) Assignee: WALMART APOLLO, LLC, Bentonville, AR (US)

( * ) Notice: Subject to any disclaimer, the term of this patent is extended or adjusted under 35 U.S.C. 154(b) by 17 days.

(21) Appl. No.: 16/297,829

(22) Filed: Mar. 11, 2019

(65) Prior Publication Data

US 2019/0304263 A1 Oct. 3, 2019

Related U.S. Application Data

(60) Provisional application No. 62/650,788, filed on Mar. 30, 2018.

(51) Int. Cl.

| | |
|---|---|
| ***G07F 19/00*** | (2006.01) |
| ***G07G 1/00*** | (2006.01) |
| ***G07G 1/10*** | (2006.01) |
| ***G07G 1/01*** | (2006.01) |

(52) U.S. Cl.
CPC ..... *G07G 1/0027* (2013.01); *G07G 1/01* (2013.01); *G07G 1/10* (2013.01)

(58) Field of Classification Search
CPC .. G06Q 10/0832; G06Q 10/083; G07F 11/62; G07F 19/202; G07F 11/38; G07F 19/20; G07F 9/06; G07F 7/06; G07F 19/203; G07F 19/205; G07F 7/04
USPC ..... 235/379; 232/43.2, 43.3
See application file for complete search history.

(56) References Cited

U.S. PATENT DOCUMENTS

| | | | | |
|---|---|---|---|---|
| 4,786,785 | A | 11/1988 | Felt | |
| 7,992,768 | B2 | 8/2011 | Benigno et al. | |
| 8,317,083 | B2 | 11/2012 | Specht | |
| D769,366 | S | 10/2016 | Hiraguchi | |
| D779,149 | S | 2/2017 | Chap et al. | |
| 2003/0116618 | A1 | 6/2003 | Masatoshi et al. | |
| 2015/0302679 | A1 * | 10/2015 | Iizuka ..... | G07D 11/40 271/207 |

OTHER PUBLICATIONS

"Heavy Duty Cash Drawer / POS Cash Box Tray with 5 Bills and 8 Coin Holders," GearBest.com, Feb. 26, 2018.
"POSGuys.com Premium Salon & Spa System," posguys.com, Feb. 26, 2018.

* cited by examiner

*Primary Examiner* — Jamara A Franklin
(74) *Attorney, Agent, or Firm* — Schmeiser, Olsen & Watts LLP; Timothy P. Collins

(57) ABSTRACT

A collection apparatus for organizing paper-based transaction items collected at a store checkout comprises a housing including a front section, rear section, left side, right side, top region, and bottom region; and an interior of the housing that is constructed and arranged into three regions. Each region includes a cavity; a removable container positioned in each cavity; three slot-shaped openings in the front section. Each slot-shaped opening is aligned with an opening in a removable container for providing a path for the paper-based transaction items to the removable container. A sensor in each cavity or container senses the paper-based transaction items received via a slot-shaped opening into the container.

16 Claims, 7 Drawing Sheets

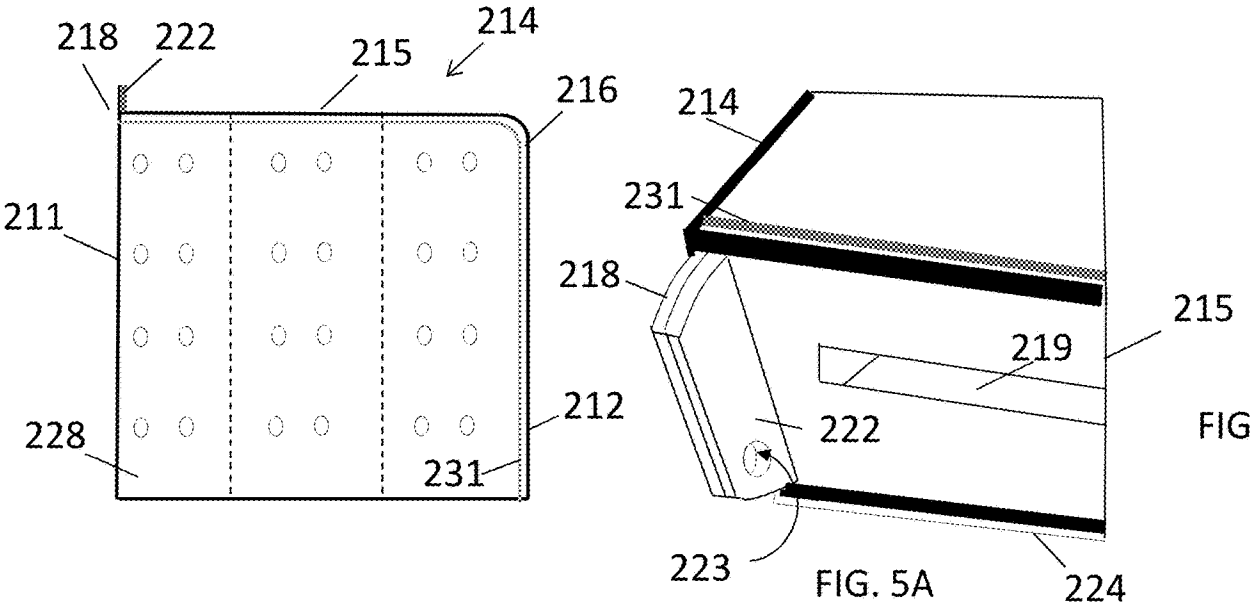
FIG. 4
FIG. 5A
FIG. 5A
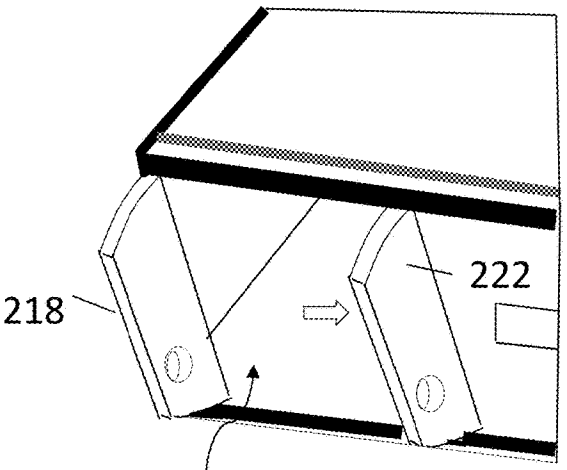
FIG. 5B
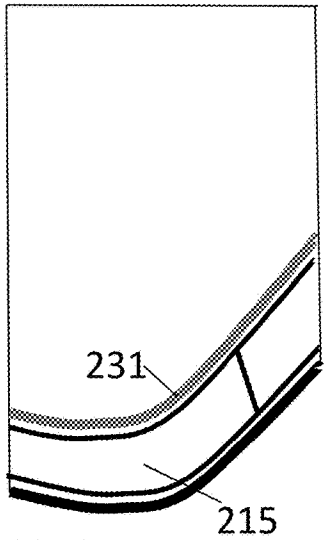
FIG. 6

COLLECTION BOX FOR POINT-OF-SALE PRINTED MATTER

CROSS REFERENCE TO RELATED APPLICATION

This invention claims priority to U.S. provisional patent application Ser. No. 62/650,788, filed Mar. 30, 2018 and entitled "Collection Box for Point-of-Sale Printed Matter," the content of which is incorporated herein by reference in its entirety.

TECHNICAL FIELD

The present disclosure relates generally to an apparatus at a point-of-sale location for arranging a variety of items, and in particular, to a collection box with a set of compartments for temporarily storing and organizing various types of printed matter such as paper currency, checks, coupons, government issued assistance notes such as food stamp coupons, debit and credit card transaction records, and/or other exchangeable documents redeemable for value.

BACKGROUND

Cash drawers at a point of sale checkout counter typically include a temporary storage area for paper currency, such as $1, $5, $10, and $20 bills. A general region of a cash drawer may be used by a cashier for checks, coupons, government assistance notes, e.g., food stamps, under the Supplemental Nutrition Program for Women, Infants, and Children (WIC) program, and/or other extraneous transferrable or exchangeable printed matter.

SUMMARY

In one aspect, a collection apparatus for organizing paper-based transaction items collected at a store checkout comprises a housing including a front section, rear section, left side, right side, top region, and bottom region; an interior of the housing that is constructed and arranged into three regions, the interior including a plurality of horizontal guides coupled to and extending from the top region common to the three reasons, and a plurality of vertical guides aligned along a common plane with the horizontal guides and extending from the rear section; each region including a cavity; a removable container positioned in each cavity; three slot-shaped openings in the front section, each slot-shaped opening aligned with an opening in a removable container for providing a path for the paper-based transaction items to the removable container; and a sensor in each cavity or container for sensing the paper-based transaction items received via a slot-shaped opening into the container.

In another aspect, a collection apparatus for organizing paper-based transaction items collected at a store checkout comprises a housing including a front section, rear section, left side, right side, top region, and bottom region; an interior of the housing that is constructed and arranged into three regions, each region including a cavity, the top section including a plurality of folding sections positioned over an interior of the housing in a closed state; a removable container positioned in each cavity, the containers exposed when the folding sections are in the open state; three slot-shaped openings in the top section, each slot-shaped opening positioned over and aligned with an opening in a removable container in the closed state for providing a path for the paper-based transaction items to the cavities defined by the vertical guides and the horizontal guides, and into which the removable containers are positioned; and a sensor in each cavity or container for sensing the paper-based transaction items received via a slot-shaped opening into the container.

In another aspect, a system for distinguishing types of paper matter at a checkout counter comprises at least one input in which various types of paper matter are inserted; at least one container in communication with the at least one input; a conveyance path for transporting the various types of paper matter from at least one input to the at least one container a receptacle along a transport path; a sensor for collecting electronic data on the various types of paper matter received via the at least one input into the at least one container; and a controller for controlling a state of the at least one input according to the electronic data.

BRIEF DESCRIPTION OF THE DRAWINGS

Exemplary embodiments will now be described, by way of example only, with reference to the following drawings, in which:

FIG. 4 is a top view of the collection box of FIG. 3.

FIG. 5A is a closeup view of a region of the collection box at which a frame locking plate and a door locking plate are in direct contact with each other, in accordance with some embodiments.

FIG. 5B is a closeup view of the region of the collection box exposing an interior when the door is separated from the frame locking plate.

FIG. 6 is a closeup perspective view of the collection box of FIGS. 3-5B with the front panel removed to expose the interior of the collection box, in accordance with some embodiments.

DETAILED DESCRIPTION

Large and small retail establishments, ranging from neighborhood convenience stores to superstores or supermarkets, typically provide a checkout environment where customers can purchase goods. Here, a cash register is used to temporarily store cash, checks, coupons, and the like that is received by the store associate by the customers. At the end of a work shift or business day, the contents of the cash register are removed as part of a point of sale (POS) revenue balancing process. Here, the collected cash as well as the checks, coupons, and other non-bank note documents are counted, then subsequently deposited at a bank, store security vault, or other location, or mailed to a vendor or other corporate entity for redemption or reimbursement.

The process performed by a store associate of categorizing the various types of received printed matter such as paper currency, checks, coupons, government issued assistance notes, and debit and credit card transaction records and counting each type is time-consuming, especially when the various types of printed matter are co-mingled and mixed together in a common area of the cash register, and must be separated into homogenous groupings for subsequent counting. Even if a counting machine is used, a categorization step is required for combining like types of printed matter together.

In brief overview, a collection box is provided according to some embodiments that includes a set of compartments for temporarily storing and organizing various types of printed matter such as paper currency, checks, coupons, government issued assistance notes such as food stamp coupons, debit and credit card transaction records, and/or other exchangeable bank note or non-note documents redeemable for value. The collection box can be collocated with a checkout system, toll booth, or any other system where cash transactions take place. The collection box is constructed and arranged to include one or more different security features, such as electrical, mechanical, and/or computer-generated locking mechanisms and/or sensors. The collection box is also configured to allow expeditious and efficient removal of removable containers, referred to as cassettes, cartridges, or related storage compartments in which the organized printed matter is stored. The configuration also includes rounded edges to reduce the risk of injury to a user when inserting and removing cartridges from the collection box.

Figure 1:
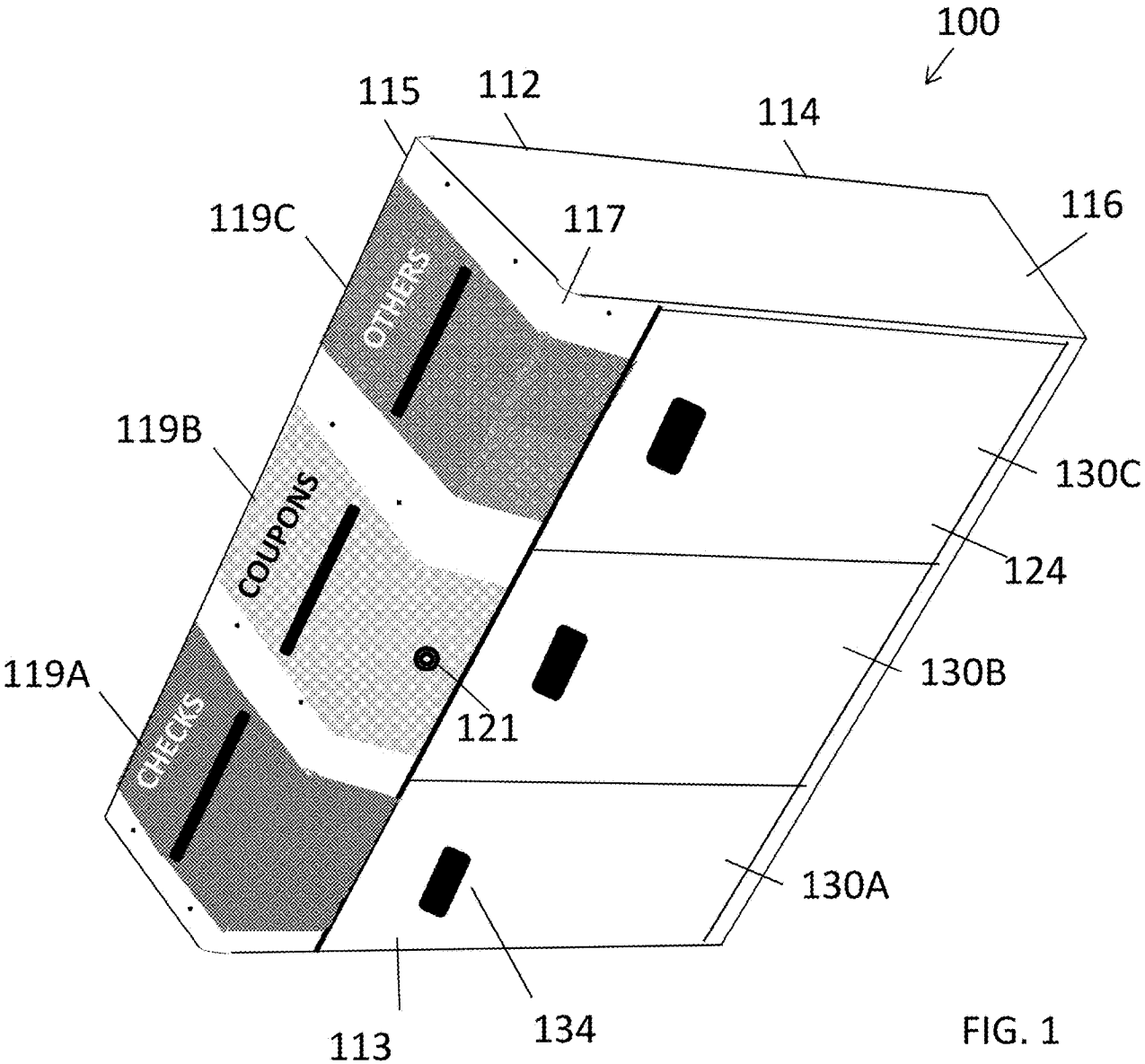
FIG. 1 depicts a perspective view of a collection box, in accordance with some embodiments.
Figure 2:
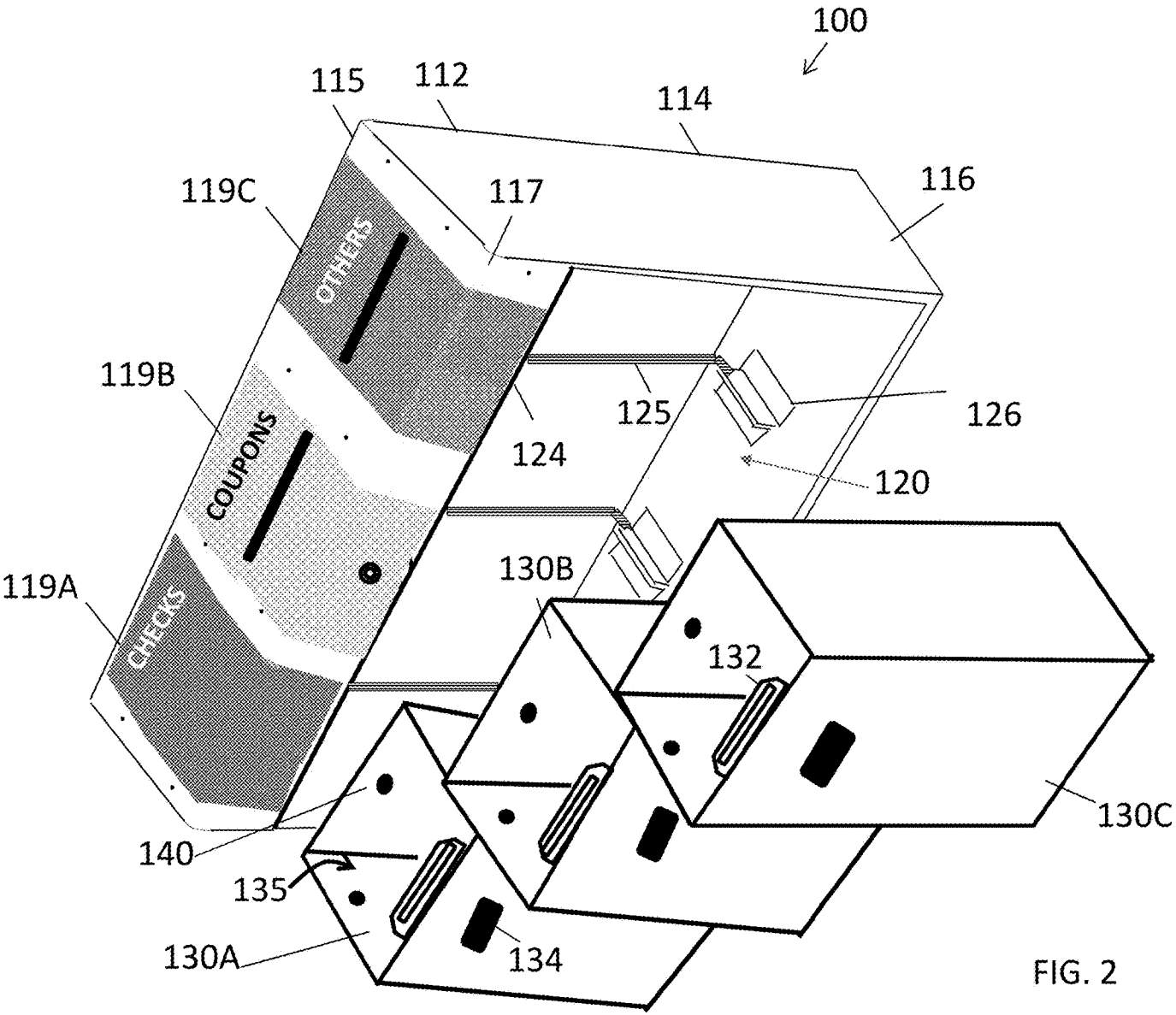
FIG. 2 is a perspective view of the collection box of FIG. 1 where three storage compartments are removed from the housing.

Referring to the drawings, FIGS. 1 and 2, illustrated are embodiments of a collection box 100. The collection box 100 includes a housing 110 having right 112, left 113, top 114, front 115, and rear 116 sections that are coupled together during assembly. In some embodiments, some or all of the sections forming the housing 110 are unitary, for example, machined or molded from a common stock such as a same piece of metal, e.g., aluminum, or plastic, polymer, or a combination thereof. In some embodiments, the collection box 100 has a width and length that is substantially greater than its height.

In some embodiments, the front section 115 is formed separately from, is coupled to, and extends between the right section 112 and left section 113 by bolts, screws, adhesives, and/or other known coupling elements. The front section 115, also referred to as a front panel, may include a lip 117 that extends from a front region, for example, perpendicularly, for coupling to the bottom section 124 of the housing 110 by bolts, screws, adhesives, and/or other known coupling elements.

The collection box 100 includes an interior 120 formed or otherwise defined by a combination of at least the right 112, left 113, top 114, front 115, and rear 116 sections. Some or all edges between adjacent surfaces of the sections may be rounded to eliminate sharp corners and reduce the risk of injury to a user such as cuts or abrasions. The interior 120 is constructed and arranged to house a set of (one or more) removable containers 130. For example, as shown, three removable containers 130A-C (generally, 130) are each aligned with a slot 119A-C (generally, 119) or other related input vehicles in the front panel 115. In some embodiments, the bottom section 124 of the housing includes an opening to the interior 120 for receiving the containers 130A-C. A surface of the three removable containers 130A-C form the bottom surface 124 of the housing 110.

Each slot 119 may have a configuration for a particular container 130, which in turn is configured to receiving and storing a particular type of paper document. In some embodiments, the slots 119A-C may have a different shape, size, or other parameter or characteristic with respect to each other. In other embodiments, the slots 119A-119C have a same shape, size, or other parameter or characteristic with respect to each other. For example, slot 119A may have a width that is suitable for receiving checks, slot 119B may have a width that is suitable for receiving smaller paper documents such as coupons, and slot 119C may have a width suitable for receiving government-issued notes or other paper documents exchanged in a sales transaction. In other embodiments, each of the slots 119 has a same width, height, and/or other dimensions.

The containers 130 are formed of plastic, metal, and/or other material suitable for an operation performed by the containers 130, for example, described herein. As shown in FIG. 2, each container 130 may have a rectangular or other shape having multiple sides and an opening 135 that is aligned with a corresponding front panel slot 119 to form a path for receiving various forms of printed matter, such as checks, coupons, and so on. In some embodiments, each container 130 may have a same shape, size, and configuration. In other embodiments, the containers 130 may have different shapes, sizes, and/or configurations.

In some embodiments, each cartridge 130 includes a handle 134 for inserting or removing the cartridge 130 with respect to the interior 120 of the collection box 100. In some embodiments, the handles 134 are presented at the bottom region 124 of the housing 110 as shown in FIG. 1. In some embodiments, the handle 134 has a locking mechanism or latch (not shown) that communicates with counterpart mechanical elements directly coupled to the housing 110, which mate with each other to lock or unlock the cartridge into the interior 120. Each cartridge 130 may include a mating coupling device 132 such as a female locking device for coupling with the coupling device 127 such as a pin. In embodiments where the handle 134 has a locking mechanism, the handle 134 controls the pin 127 and/or female opening 132 in the cartridge to perform a locking or unlocking function.

In order for the containers 130 to be inserted and aligned in the interior 120 of the collection box 100 and for the cartridge openings 135 to be aligned with a front panel slot 119, as shown in FIG. 2, in some embodiments the interior 120 includes a plurality of horizontal guides 125 coupled to and extending from the top region 114, vertical guides 126 aligned along a common plane with the horizontal guides 125 and extending from the rear section 116, and one or more coupling devices 127 extending from the front panel 115, such as clips for receiving and holding in place the cartridges 130 in an interior region divided into cavities or sub-regions defined by the guides 125, 126 for each cartridge 130A-C. For example, as shown in FIG. 2, a horizontal 125 and/or vertical 126 guide may be formed of an elongated sheet of metal or the like having an "L-shape" where one section of the guide extends perpendicularly from the interior surface, i.e., from the top region 114. A combination of the horizontal 125 and vertical 126 guides forms a region in the interior 120 for temporarily housing a cartridge 130, which can be locked in place in its respective region by the coupling device 127.

The collection box 100 may have one or more different security features. One such feature is a security lock configuration. In some embodiments, as shown in FIG. 1, the front panel 115 includes a lockable button 121 key lock, or the like for securing the front panel 115 to center container 130B positioned in the interior 120 of the collection box 100 so that only authorized users can remove and transport one or more containers 130 positioned therein. The lockable button 121 may include a keyhole, an electronic keypad, combination lock, or other security-related apparatus that controls a movement of the pins or the like inside the collection box 100 that mate with the locking device 132 of each of the containers 130. In some embodiments, the locking mechanism 121 securely locks all three containers 130A-C in their respective cavities in the housing, so that all containers can be removed by unlocking the containers via the locking mechanism.

Another security feature includes the presence of one or more sensors 140 coupled to or otherwise in communication with the interior 120 of the collection box 100 and/or each container 130. In some embodiments, a sensor 140 is a measurement sensor, transducer, or the like that includes a driver that delivers electrical signals to the transducer, piezoelectric device, or the like in the sensor, which vibrates or oscillates to create sound wave that propagates inside the container. In doing so, the sound wave may reach a stack of papers inside the container, for example, one or more checks each inserted into a slot 119 and stacked inside the container 130. The sensor 140 can measure the amount of time required for the sound wave to travel to and from the sensor. A microprocessor (not shown) in the container 130 or collection box 100 may calculate the travel distance, which in turn can calculate an amount of paper material inside the container 130 and/or an amount of available space in the container 130 for receiving additional checks. Therefore, the sensor 140 can also be used to determine whether the container 130 has a maximum capacity with respect to the checks. In some embodiments, the microprocessor may communicate with a door or the like that can automatically be positioned over the slot 119 when the sensor establishes that the container is full and incapable of receiving additional paper items. The microprocessor may communicate via wired or wireless connections with a processor that controls the state of the slot 119, i.e., whether it is open or closed. Although one example of a representative sensor 140 is described, the container 130 may be configured with other types of sensors 140, which may equally apply with respect to determine a storage capacity of the container 130.

In some embodiments, the sensors 140 may detect a specific type of printed matter. For example, a sensor 140 inside container 130A may be configured to identify checks and distinguish the checks from other types of printed matter such as coupons and government-issued notes, for example, by optical sensing and collection of written or typed print on the checks, and sending the generated sensor data to the microprocessor in the container 130 or a remote analytics computing device, for example, via a wireless interface (not shown) on the container 130 or device housing 110. In some embodiments, a container 130 may have a different shape, size, or configuration than the other containers due to a unique size of the corresponding slot 119 and the type of paper matter to be received. For example, container 130A may be configured to receive checks only, and therefore has an interior 135 with a dimension to receive checks of a particular maximum dimension. In this example, a sensor 140 in the container 130A may be arranged to detect only checks, for example, a barcode, written text on the check, and so on.

In some embodiments, one or more sensors 140 may be configured to determine a number or value of checks, cash, coupons, bank notes, and so on stacked in each container 130. These sensors 140 may output data to a display unit (not shown), for example, on a surface of the housing 110, which in turn displays the total value(s) of the contents of one or more containers 130. The display unit, for example, a light emitting diode (LED) display or other electronic display, may increment as paper documents are inserted into a slot 119 to a particular container 130 then scanned or otherwise sensed to determine the value of the inserted documents. In other embodiments, the sensors 140 may be positioned on opposite sides of the container interior to capture information from both sides of an inserted document, for example, to capture a signature as well as a value of a check. The display may present other information such as a confirmation or authorization of a received paper document.

Sensor examples are described but not limited thereto. For example, other sensors 140 may include but not be limited to a magnetic sensor, an infrared sensor, weight sensor, motion sensor, an ultraviolet/fluorescent light scan head, or an image scanner. For example, a sensor 140 may detect humidity, liquid (for spills), capacity, forgery, biometrics, shock, and so on. For example, a shock sensor may be provided to determine whether the box 100 is tampered with, for example, attempts to break into the box 100 to obtain access to the paper contents. In some embodiments, the collection box 100 communicates with a controller, for example, a remote controller or controller of the collection box 100 for communicating with the sensors 140 to determine from collected data an identification of items inserted into the collection box 100, to distinguish the received item from other items, to determine a value of the contents, for example, a value of coupons in the coupon bin of a container 130, or a denomination of bank notes in another container 130, and so on. In some embodiments, each cavity in the interior region of the collection box 100 and/or each cartridge 130 removably housed in a corresponding cavity includes a different sensor, depending on the function of the cartridge. For example, cartridge 130C is constructed and arranged for storing paper currency such as dollar bills may include a sensor 140 configured to determine whether the paper currency is legal tender or counterfeit currency, or can distinguish between one, five, ten, twenty, and fifty dollar bills (in U.S. currency). Cartridge 130A on the other hand includes a sensor 140 that monitors checks, while cartridge 130B includes a barcode or RFID sensor that can confirm the legitimacy of coupons.

Another security feature may include a cover or door (not shown) that securely couples to an opening to the interior 135 of the container 130. Here, the cover or door may include a slot configured for aligning with the corresponding slot 119 of the housing 110. The cover or door of the container may include a lock, electronic pad, or other apparatus that allows the cover or door to open and close so that paper contents can be removed. In some embodiments, the collection box 100 may include a covering that is positioned over one or more slots 119 for preventing access to the contents in the containers 130.

FIGS. 3-6 are various views of a collection box 200, in accordance with other embodiments. The collection box 200 may include similar features as the collection box 100 described in FIGS. 1 and 2 that are not repeated for brevity. However, the collection box 200 includes the following differences.

In some embodiments, the collection box 200 includes a housing 210, which in turn comprises a frame 211, as well as side surfaces, a top section 214, and a bottom section 224 coupled to the frame 211 or otherwise integral with the frame 211, for example, molded of a common source of material such as plastic for forming both the frame 211 and the surfaces/sections. The housing 210 also includes a rear section (obscured in FIG. 2) and a front door 215. Unlike the collection box 100 of FIGS. 1 and 2, the front door 215 in FIGS. 3-6 is otherwise movable from the front region to another section, e.g., right side 212 to expose an interior 220, for example, shown in FIGS. 5B and 6. In some embodiments, the front door 215 includes a roll up cover door that opens to expose the containers 130 each in a respective housing cavity.

Figure 3:
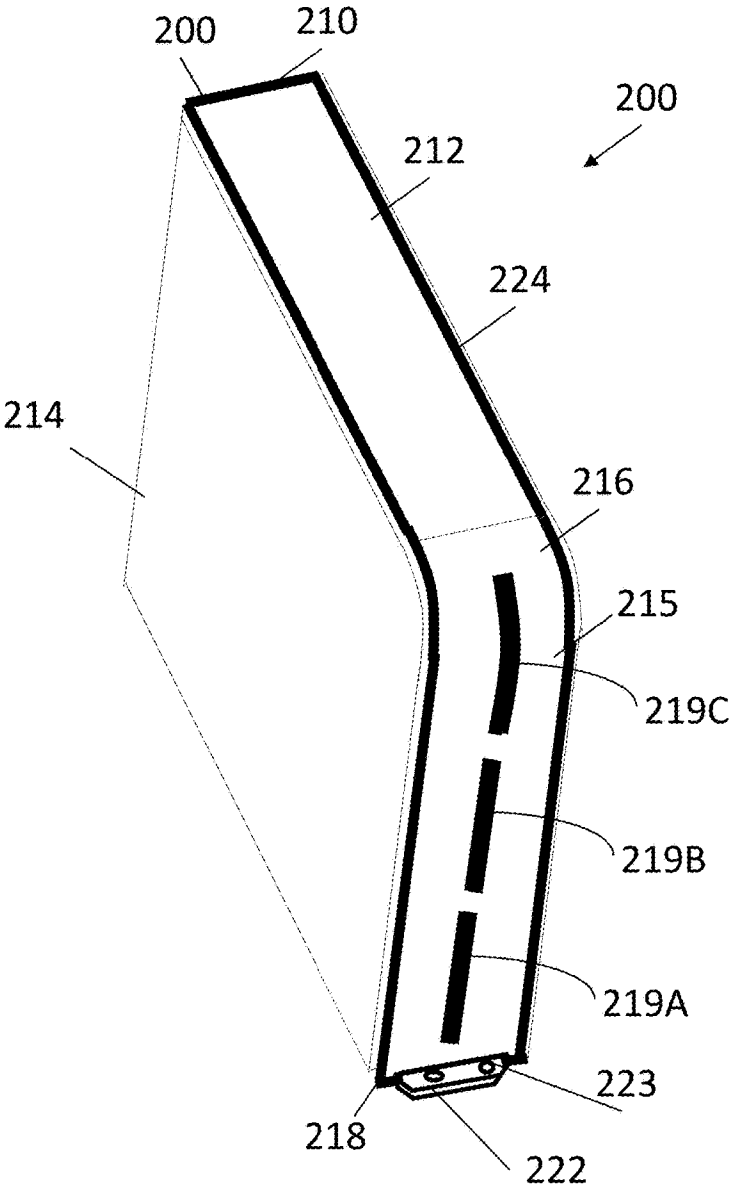
FIG. 3 depicts a perspective view of a collection box, in accordance with other embodiments.

As shown in FIGS. 3 and 4, the collection box 200 has a curved or rounded corner 216 or related region of curvature between the right side surface 212 and the front door 215. The curved corner 216 is preferably on an opposite side of the front door 215 as a door locking plate 222, described herein with respect to FIGS. 5A and 5B. The curved corner 216 is constructed and arranged for allowing for the top card slotted door 215 to slide back along the side surface opposite the curved corner 216 via grooves, rails, wheels, and/or other alignment elements, to expose the interior when the containers 230 need to be extracted via the front region. In other embodiments, the curved corner 216 may extend between the left side surface and the front region so that the door 215 can slide to the left via the curved corner 216. The set of hinged pieces positioned over the slotted door 215 or forming the door 215 may be arranged to allow bending or other conforming about the curved corner 216 in order to move from one side to another side of the collection box 200. In particular, the door 215 can be positioned over the opening to the housing 210 when in a closed state.

In some embodiments, as shown in the top view of FIG. 4, the top section 214 of the collection box 200 includes a groove 231 that extends along the curved corner 216 and a periphery of the two sides that form the curved corner 216. The groove 231 may be for aligning the door 215 or allow the door 215 to slide inside or along the groove 231. The top section 214, the bottom section 224, and/or other region of the housing 210 may include magnets 228 or other objects for removably coupling the housing 210 to a stationary surface, for example, under a desk, console, or wall.

In some embodiments, the front door 215 includes a door locking plate 222 that protrudes from one side of the door 215 in a direction away from the collection box 200. The frame 211 has a frame locking plate 218 that neighbors with the door locking plate 222 so that a hole 223 in the door locking plate 222 and a hole (not numbered) in the frame locking plate are aligned for receiving a bolt, padlock, or other locking element that extends through the aligned holes. Accordingly, the front door 215 can be secured when locked so that the front door 215 cannot slide into an open position, as shown in FIG. 5B. Also, in the closed state, the door 215 can be locked since the door locking plate 222 in the closed state is proximal or abuts the frame locking plate. The curved corner 216 allows the door 215 to transition between the open state and the closed state since the curved corner 216 provides a path for the door 215, which may "bend" or otherwise adapt to the curved corner 216 during the transition between the open state and the closed state.

As shown in FIG. 3, the front door 215 has a plurality of slots 219, for example, three slots 219A-C (generally, 219) that is configured to align with a particular container 230 inside the housing 210, which in turn is configured to receiving and storing a particular type of paper document, similar to the collection box 100 of FIGS. 1 and 2. The containers 230 may be arranged and secured in cavities or the like via guide rails or other alignment features similar to those described in the collection box 100 of FIGS. 1 and 2. The collection box 200 may include containers, sensors, locks, and so on that are similar to or the same as those described in other embodiments herein. Details are not repeated for brevity.

Figure 7:
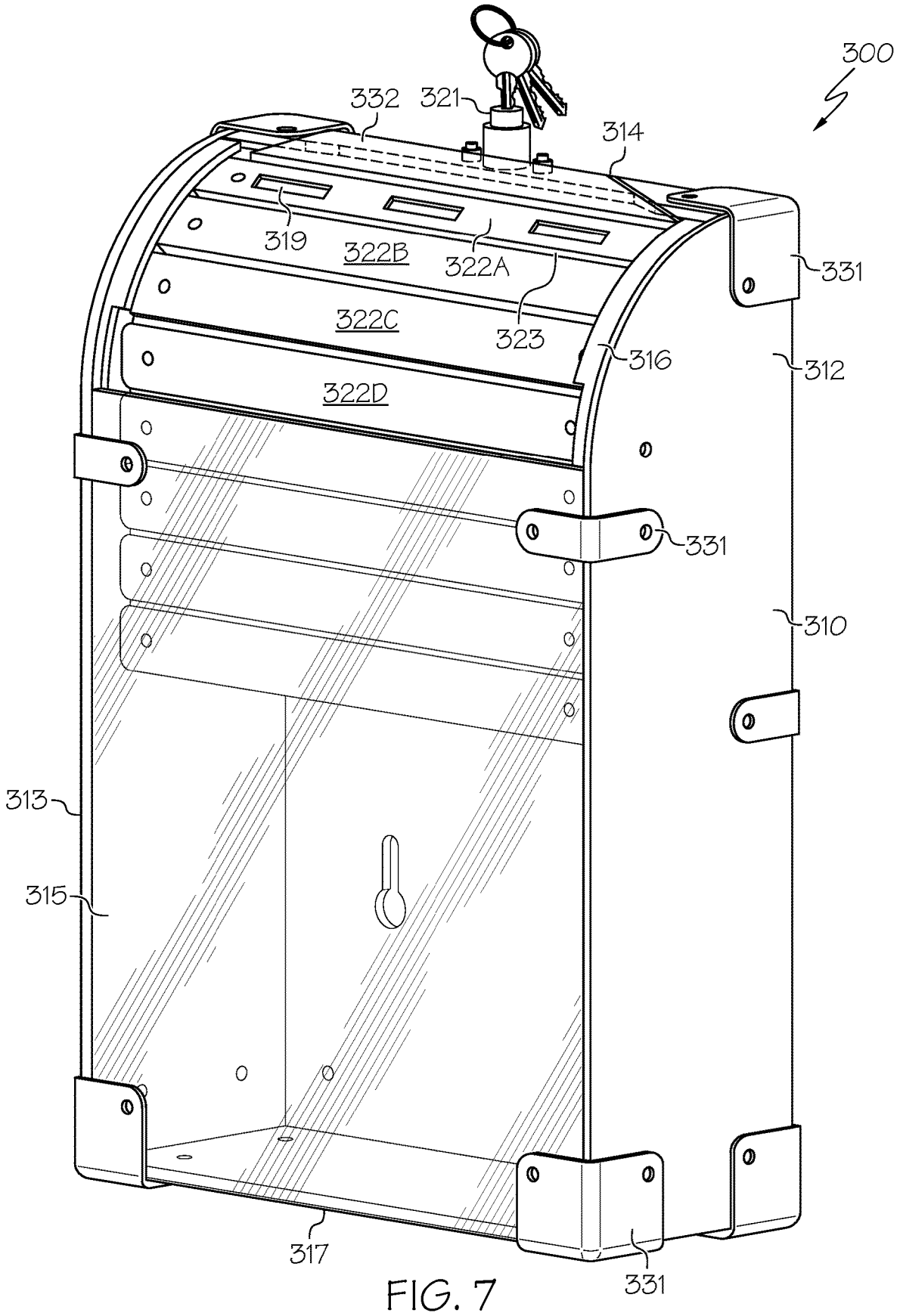
FIG. 7 depicts a perspective view of a collection box, in accordance with other embodiments.
Figure 8:
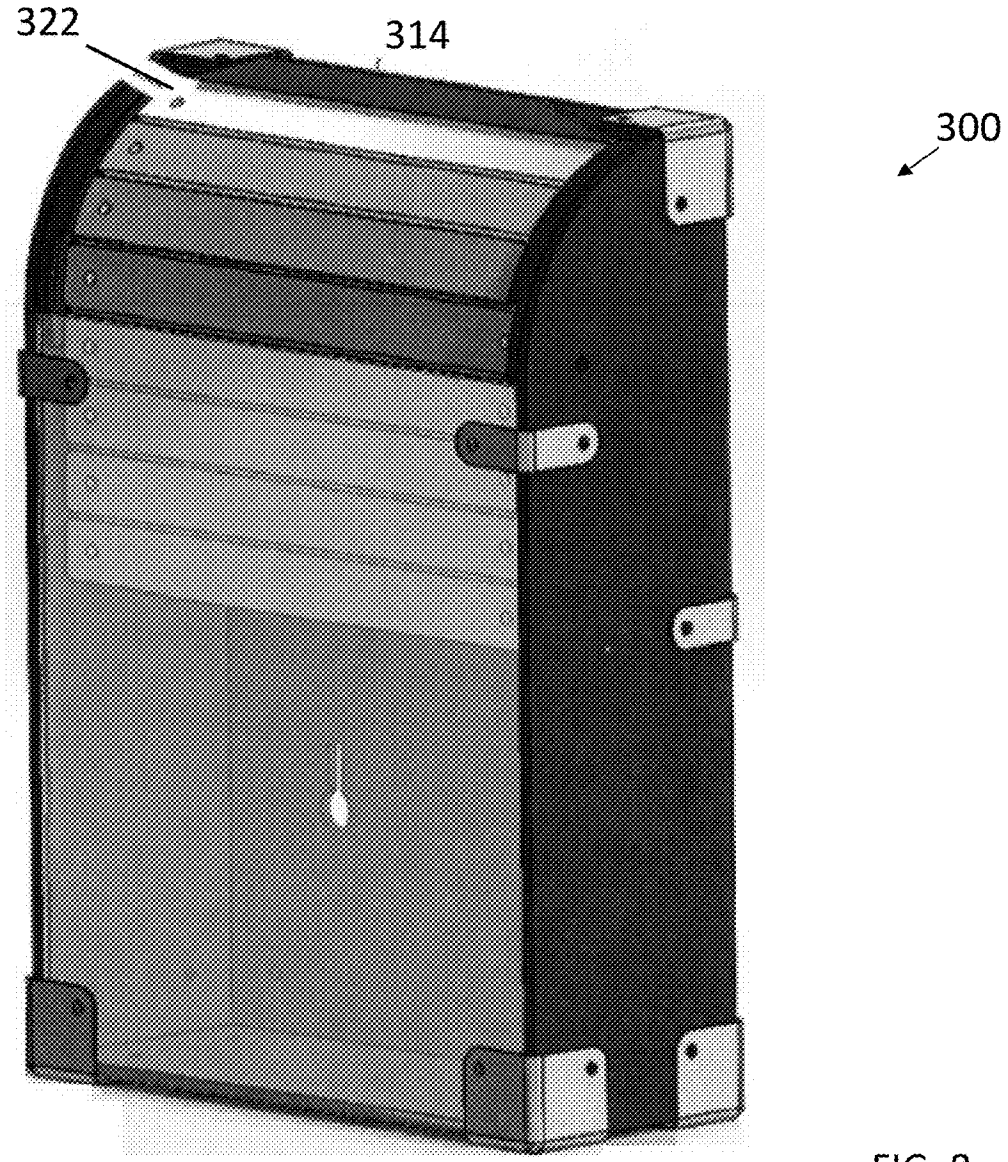
FIG. 8 is a perspective view of the collection box of FIG. 7 in a closed state.
Figure 9:
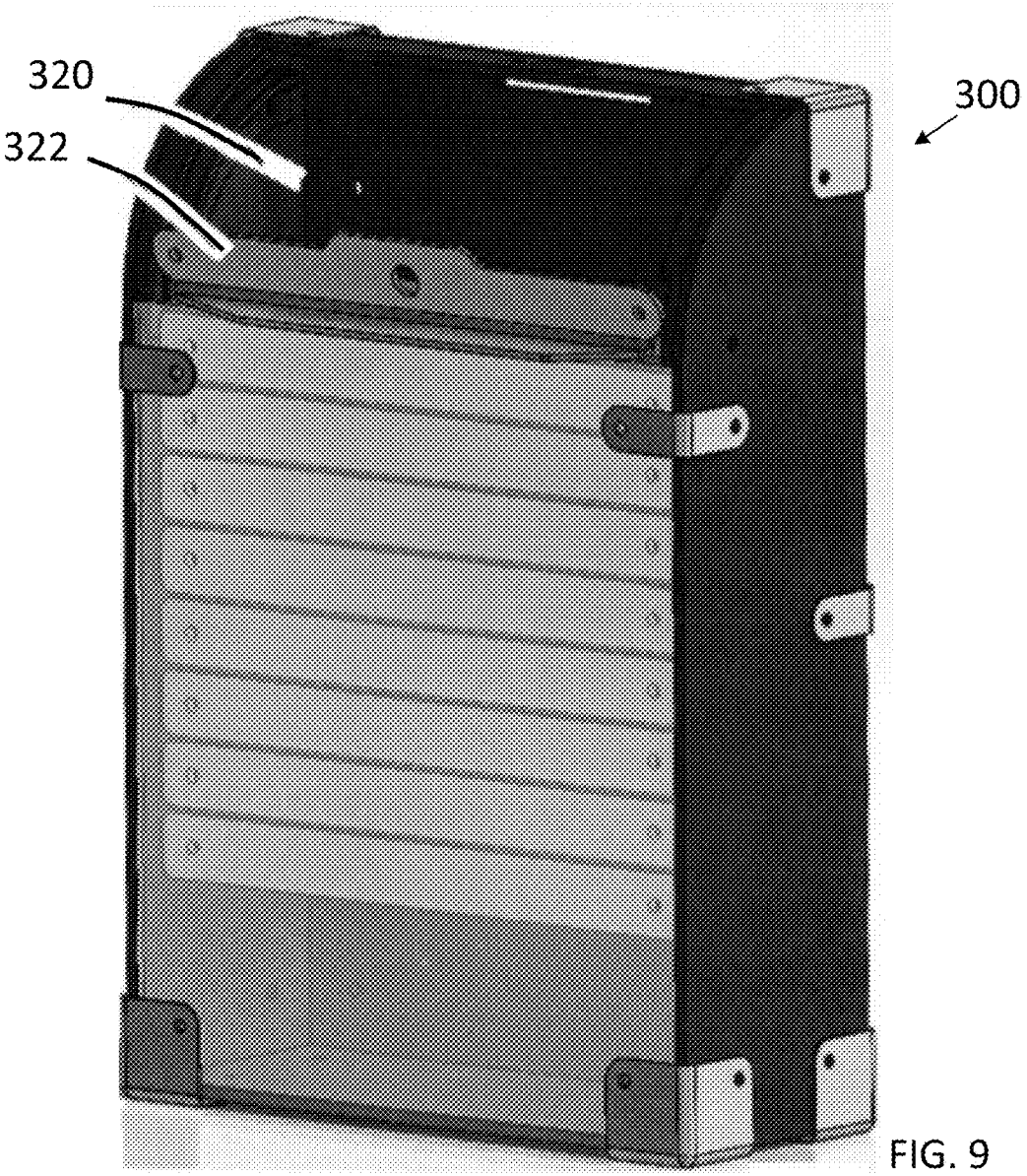
FIG. 9 is a perspective view of the collection box of FIGS. 7 and 8 in an open state.

FIGS. 7-9 are various views of a collection box 300, in accordance with other embodiments. The collection box 300 may include similar features as the collection box 100 described in FIGS. 1 and 2 and/or the collection box 200 described in FIGS. 3-8 that are not repeated for brevity. However, the collection box 300 includes several differences. For example, collection box 300 has a configuration that includes a height that is greater than its width and length.

The collection box 300 includes a housing 310 having right 312, left 313, top 314, front 315, and rear sections. In some embodiments, each of the right 312 and left 313 sections has a curved corner 316 that extends from the rear to the front section 315. The top region 314 has a plurality of folding sections 322A-322D (generally, 322) movably coupled to each other. Each folding section 322 forms a hinge 323 with a directly adjacent folding section 322 to allow the two adjacent folding sections to rotate about the hinge along a hinge 323. The movement of the folding sections 322 relative to each other allows the top region 314 to function as a roll up cover door that opens to expose the containers positioned in the interior of the housing. At least some of the folding sections, for example, at least the lower folding sections 322C, D, can slide down along an interior surface of the front surface 315 as shown so that the interior 320 is exposed, which in turn allows removable containers therein to be exposed for removal and insertion. In some embodiments, at least some of the folding sections slide under a portion of a frame of the top region 314 as shown in FIGS. 8 and 9.

One of the folding sections 322, for example, top section 322A has a plurality of slots 319A-C (generally, 319) each configured to align with a particular container 330 inside the housing 310, which in turn is configured to receiving and storing a particular type of paper document, similar to the collection box 100 of FIGS. 1 and 2 and collection box 200 of FIGS. 3-8. The top folding section 322A may also include a lip 332 or the like for allowing a user to pull the folding sections 322 in a downward direction to form an opening to the interior 320.

The collection box 300 in FIGS. 7-9 may also include a number of brackets 331 or related coupling elements for securing the various parts of the housing 310 to each other.

The collection box 300 may include containers, sensors, locks 321, and so on that are similar to or the same as those described in other embodiments herein. Details are not repeated for brevity. For example, the collection box 300 may be part of a system that includes a controller that controls the state of the inputs to the containers, i.e., by sending an electronic signal to a screen, covering, or the like that automatically positions over an opening 319 to prevent additional items from being inserted into the container via the opening due to a determination from the sensor data and controller that the container is full.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above.

What is claimed:

1. A collection apparatus for organizing paper-based transaction items collected at a store checkout, comprising:

a housing including a front section, rear section, left side, right side, top region, and bottom region;

an interior of the housing that is constructed and arranged into three regions, each region including a cavity, the interior including a plurality of horizontal guides coupled to and extending from the top region common to the three regions, and a plurality of vertical guides aligned along a common plane with the horizontal guides and extending from the rear section;

a removable container positioned in each cavity;

three slot-shaped openings in the front section, each slot-shaped opening aligned with an opening in a removable container for providing a path for the paper-based transaction items to the cavities defined by the vertical guides and the horizontal guides, and into which the removable containers are positioned; and a sensor in each cavity or container for sensing the paper-based transaction items received via a slot-shaped opening into the container.

2. The collection apparatus of claim 1, wherein the bottom of the housing includes an opening, and wherein a surface of the three removable containers form a bottom surface of the housing.

3. The collection apparatus of claim 1, wherein the front section is removable for exposing the interior and for inserting and removing the containers.

4. The collection apparatus of claim 1, wherein the paper-based transaction items include checks, coupons, and government issued assistance notes.

5. The collection apparatus of claim 4, wherein a first of the three slot-shaped openings and a corresponding first removable container in a first cavity are each configured for receiving only the checks, a second of the three slot-shaped openings and a corresponding second removable container in a second cavity are each configured for receiving only the coupons, and a third of the three slot-shaped openings and a corresponding third removable container in a third cavity are each configured for receiving only the government issued assistance notes.

6. The collection apparatus of claim 1, wherein a front panel of the front section includes a locking mechanism for securing the front panel to a securing mechanism that securely couples all of the removable containers in the housing.

7. The collection apparatus of claim 1, further comprising a door locking plate that secures a door of the front section against the housing.

8. The collection apparatus of claim 7, wherein the door locking plate is tangential to the door and includes a hole that aligns with a frame locking plate extending from the left or right side of the housing.

9. The collection apparatus of claim 1, further comprising a region of curvature extending from the front section to one of the left or right sides constructed and arranged for providing a path for a front door when the door transitions between an open state and a closed state.

10. The collection apparatus of claim 1, wherein the sensor includes sensors on opposite sides of an interior of the container to capture information from both sides of the paper-based transaction items in the container.

11. A collection apparatus for organizing paper-based transaction items collected at a store checkout, comprising:

a housing including a front section, rear section, left side, right side, top region, and bottom region;

an interior of the housing that is constructed and arranged into three regions, each region including a cavity;

a plurality of folding sections positioned over an interior of the housing in a closed state;

a removable container positioned in each cavity, the containers exposed when the folding sections are in the open state;

three slot-shaped openings in the top section, each slot-shaped opening positioned over and aligned with an opening in a removable container in the closed state for providing a path for the paper-based transaction items to the removable container; and a sensor in each cavity or container for sensing the paper-based transaction items received via a slot-shaped opening into the container.

12. The collection apparatus of claim 11, wherein at least some of the folding sections of the top section are directed to the rear section via a region of curvature when in the closed state.

13. The collection apparatus of claim 11, wherein the section includes a locking mechanism for securing a top section of the folding sections to the housing in the closed state.

14. A system for distinguishing types of paper matter at a checkout counter, comprises:

a housing having three inputs each including a slot-shaped opening in which various types of paper matter are inserted;

three containers, each of the three containers in communication with one of the three inputs; and a conveyance path for transporting the various types of paper matter from at least one of the three inputs to at least one of the three containers, each slot-shaped opening aligned with an opening in a corresponding container of the at least three containers for providing the conveyance path to the at least one container, wherein a first of the slot-shaped openings and a corresponding first removable container in a first cavity of the housing are configured for receiving only checks of the various types of paper matter, a second of the slot-shaped openings and a corresponding second removable container in a second cavity of the housing are configured for receiving only coupons of the various types of paper matter, and a third of the slot-shaped openings and a corresponding third removable container in a third cavity of the housing are each configured for receiving only other types of the various paper matter.

15. The system of claim 14, further comprising a locking mechanism for covering an opening to the housing so that the at least one container is securely enclosed inside the housing.

16. The system of claim 14, wherein the first, second, and third removable containers are removed from and inserted into the first, second, and third cavities, respectively, in a direction perpendicular to the three inputs of the housing.

* * * * *